US011821694B2

(12) United States Patent
Norèn et al.

(10) Patent No.: US 11,821,694 B2
(45) Date of Patent: Nov. 21, 2023

(54) HEAT TRANSFER PLATE AND CASSETTE FOR PLATE HEAT EXCHANGER

(71) Applicant: ALFA LAVAL CORPORATE AB, Lund (SE)

(72) Inventors: Mattias Norèn, Malmö (SE); Johan Nilsson, Ronneby (SE)

(73) Assignee: ALFA LAVAL CORPORATE AB, Lund (SE)

( * ) Notice: Subject to any disclaimer, the term of this patent is extended or adjusted under 35 U.S.C. 154(b) by 508 days.

(21) Appl. No.: 17/258,557

(22) PCT Filed: Jul. 19, 2019

(86) PCT No.: PCT/EP2019/069509
§ 371 (c)(1),
(2) Date: Jan. 7, 2021

(87) PCT Pub. No.: WO2020/038668
PCT Pub. Date: Feb. 27, 2020

(65) Prior Publication Data

US 2021/0270537 A1 Sep. 2, 2021

(30) Foreign Application Priority Data

Aug. 24, 2018 (EP) ..... 18190695

(51) Int. Cl.
*F28D 9/00* (2006.01)
*F28F 9/007* (2006.01)

(52) U.S. Cl.
CPC ..... *F28D 9/005* (2013.01); *F28F 9/0075* (2013.01); *F28F 2225/04* (2013.01)

(58) Field of Classification Search
CPC .... F28D 9/0031; F28D 9/0037; F28D 9/0056; F28D 9/0043; F28D 9/005; F28D 9/0075; F28F 9/0075; F28F 2225/04
See application file for complete search history.

(56) References Cited

U.S. PATENT DOCUMENTS 2,601,974 A 7/1952 Larsson
2,872,165 A * 2/1959 Wennerberg ..... F28F 3/046 165/166

(Continued)

FOREIGN PATENT DOCUMENTS

CN 1209199 A 2/1999
CN 101162132 A 4/2008

(Continued)

OTHER PUBLICATIONS

Search Report dated Aug. 18, 2021, by the Federal Service for Intellectual Property (ROSPATENT) in corresponding Russian Patent Application No. 2021107555/12(016341) . (2 pages).

(Continued)

*Primary Examiner* — Jianying C Atkisson
*Assistant Examiner* — For K Ling
(74) *Attorney, Agent, or Firm* — BUCHANAN INGERSOLL & ROONEY PC

(57) ABSTRACT

A heat transfer plate includes a first bar engagement comprising a first recess and a first edge portion surrounding the first recess, and a second bar engagement portion comprising a second recess and a second edge portion surrounding the second recess. A part of the first edge portion extends from a first plane to a parallel third plane, and a part of the second edge portion extends from the first plane to a fourth plane. The second and third planes are on the same side of the first plane, the third and fourth planes are a distance from the first plane, and the at least a part of the first edge portion projects from a front of the plate. An edge of the first edge portion defines a first area and an edge of the second edge portion defines a second area, the first area fitting inside the second area.

15 Claims, 7 Drawing Sheets

(56) References Cited

U.S. PATENT DOCUMENTS

| | | | | | |
|---|---|---|---|---|---|
| 4,781,248 | A * | 11/1988 | Pfeiffer | F28F 3/042 165/166 |
| 5,056,590 | A | 10/1991 | Bohn | |
| 5,587,053 | A * | 12/1996 | Keith | F28F 3/083 202/202 |
| 5,992,510 | A * | 11/1999 | Kallrot | F28D 9/005 165/167 |
| 6,161,615 | A | 12/2000 | Brieden et al. | |
| 9,046,310 | B2 * | 6/2015 | Joensen | F28F 3/083 |
| 2004/0069473 | A1 * | 4/2004 | Blomgren | F28D 9/005 165/167 |
| 2008/0236802 | A1 | 10/2008 | Koepke et al. | |
| 2011/0297350 | A1 * | 12/2011 | Gidner | F28F 9/0075 165/67 |
| 2016/0109189 | A1 * | 4/2016 | Davies | F28F 9/0243 165/173 |
| 2016/0123676 | A1 | 5/2016 | Lee et al. | |

FOREIGN PATENT DOCUMENTS

| | | | | |
|---|---|---|---|---|
| CN | 201463670 | U | 5/2010 | |
| CN | 201476664 | U | 5/2010 | |
| CN | 102187174 | A | 9/2011 | |
| CN | 101922869 | B | 1/2013 | |
| CN | 103791757 | A | 5/2014 | |
| CN | 106662412 | A | 5/2017 | |
| CN | 207019514 | U | 2/2018 | |
| DE | 27 41 712 | A1 | 3/1978 | |
| EP | 0 450 822 | A1 | 10/1991 | |
| EP | 1531314 | B1 * | 11/2006 | F28D 9/005 |
| GB | 1592069 | A | 7/1981 | |
| JP | H03-244992 | A | 10/1991 | |
| JP | H09264685 | A | 10/1997 | |
| JP | 2774999 | B2 | 7/1998 | |
| JP | 2000-502786 | A | 3/2000 | |
| JP | 2001-526765 | A | 12/2001 | |
| JP | 2006-010192 | A | 1/2006 | |
| JP | 2012-510606 | A | 5/2012 | |
| JP | 2016-090221 | A | 5/2016 | |
| RU | 17 606 | U1 | 4/2001 | |
| RU | 2 225 580 | C2 | 3/2004 | |
| RU | 2 472 091 | C1 | 1/2013 | |
| RU | 132 175 | U1 | 9/2013 | |
| TW | 1445917 | B | 7/2014 | |
| WO | 97/23759 | A1 | 7/1997 | |
| WO | 98/54527 | A2 | 12/1998 | |
| WO | 99/36741 | A1 | 7/1999 | |
| WO | 2008063121 | A1 | 5/2008 | |
| WO | 2009082336 | A1 | 7/2009 | |
| WO | 2010/044723 | A2 | 4/2010 | |
| WO | 2010064975 | A2 | 6/2010 | |
| WO | 2011162659 | A1 | 12/2011 | |
| WO | 2014/067757 | A1 | 5/2014 | |
| WO | 2015/193057 | A1 | 12/2015 | |

OTHER PUBLICATIONS

English Translation of the Office Action (Notice of Preliminary Rejection) dated Sep. 14, 2022 by the Korean Intellectual Property Office in corresponding Korean Patent Application No. 10-2021-7008250. (4 pages).

English Translation of the Office Action (First Office Action) dated Jan. 27, 2022, by the National Intellectual Property Administration, P. R. China in corresponding Chinese Patent Application No. 201980055403.7. (5 pages).

International Search Report (PCT/ISA/210) dated Dec. 11, 2019, by the European Patent Office as the International Searching Authority for International Application No. PCT/EP2019/069509.

Written Opinion (PCT/ISA/237) dated Dec. 11, 2019, by the European Patent Office as the International Searching Authority for International Application No. PCT/EP2019/069509.

English Translation of the Office Action (Notice of Reasons for Rejection) dated Apr. 4, 2022, by the Japanese Patent Office in corresponding Japanese Patent Application No. 2021-532516. (5 pages).

* cited by examiner

HEAT TRANSFER PLATE AND CASSETTE FOR PLATE HEAT EXCHANGER

TECHNICAL FIELD

The invention relates to a heat transfer plate for a plate heat exchanger comprising opposing first and second recesses arranged to receive a first and a second bar, respectively, of the plate heat exchanger. The first and second recesses are at least partly surrounded by a first and a second edge portion, respectively. The invention also relates to a cassette for a plate heat exchanger comprising two such heat transfer plates bonded together.

BACKGROUND ART

Plate heat exchangers, PHEs, typically comprises two end plates in between which a number of heat transfer plates are arranged in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

In one type of well-known PHEs, the so called semi-welded PHEs, the heat transfer plates are typically "flipped" in relation to each other and welded in pairs to form tight cassettes, and gaskets are arranged between the cassettes. The end plates, and therefore the cassettes, are pressed towards each other by some kind of tightening means whereby the gaskets seal between the cassettes. Parallel flow channels are formed between the heat transfer plates, one channel between each pair of adjacent heat transfer plates. Two fluids of initially different temperatures, which are fed to/from the PHE through inlets/outlets, can flow alternately through every second channel for transferring heat from one fluid to the other, which fluids enter/exit the channels through inlet/outlet port holes in the heat transfer plates communicating with the inlets/outlets of the PHE.

The end plates of a semi-welded PHE are often referred to as frame plate and pressure plate. The frame plate is often fixed to a support surface such as the floor while the pressure plate is movable in relation to the frame plate. Often, an upper bar for carrying or supporting, and aligning, the heat transfer plates, and possibly also the pressure plate, is fastened to the frame plate and extends from an upper part thereof, past the pressure plate and to a support column. Similarly, a lower bar for guiding or supporting, and aligning, the heat transfer plates, and possibly also the pressure plate, is fastened to the frame plate and extends from a lower part thereof, at a distance from the ground, past the pressure plate and to the support column. To this end, the heat transfer plates are typically provided with upper and lower bar engagement portions comprising upper and lower recesses for receiving the upper and the lower bar, respectively.

The heat transfer plates for semi-welded PHEs, hereinafter also referred to as just "plates", are manufactured from metal sheets of different thicknesses which are cut so as to provide the plates with the above mentioned inlet/outlet port holes and upper and lower recesses. Thereafter, the plates are pressed so as to be provided with a specific corrugation pattern and possibly collars surrounding the upper and lower recesses. These collars reinforce the upper and lower recesses and make them more resistant to deformation resulting from the engagement with the upper and lower bars. To make sure that the collars of one plate do not interfere with the collars of another plate in a semi-welded PHE, the collars should not extend beyond the corrugations of the plates. Accordingly, on plates having a relatively small pressing depth, the collars may be relatively small or shallow and thus weak. Also, the collars of two different plates having two different thicknesses will be different even if the same pressing tool is used to press the two different plates. Especially, an inclination of the collars is relation to a respective central extension plane of the plates may differ between the plates. For a thicker plate, the plate may be bent relatively sharply to form the collar while, for a thinner plate, the plate may be bent less sharply. Thus, if a collar depth is said to be the perpendicular extension, in relation to the central extension plane of a plate, of a collar, the collar depth for a thicker plate will be larger than the collar depth for a thinner plate. A collar with a smaller collar depth is generally weaker than a collar with a larger collar depth. Accordingly, for it to be possible to obtain a sufficiently strong collar for plates of different thickness, it may be necessary to use different cutting tools for different plate thicknesses, which may be cumbersome and costly.

SUMMARY

An object of the present invention is to provide a heat transfer plate and a cassette that at least partly solve the above mentioned problems. The basic concept of the invention is to give the upper and lower bar engagement portions of the heat transfer plate different designs to allow any collar to extend beyond the corrugations without there being a risk of interference between the collars of a number of heat transfer plates according to the invention when these are properly arranged in a plate pack. Thereby, since the collar may extend beyond the corrugations of the plate, the plate may be cut such that a sufficient collar depth is achieved after pressing irrespective of the thickness of the plate. This may enable the use of one single cutting tool for plates of different thicknesses.

A heat transfer plate, for a plate heat exchanger, according to the present invention, has a thickness t and comprises first and second opposing sides, a first bar engagement portion along the first side, a second bar engagement portion along the second side, and an outer edge part comprising corrugations extending between and in first and second planes. The first and second planes are parallel to each other and separated by a distance=x. The first bar engagement portion comprises a first recess for receiving a first bar of the plate heat exchanger and a first edge portion surrounding the first recess. The second bar engagement portion comprises a second recess for receiving a second bar of the plate heat exchanger and a second edge portion surrounding the second recess. At least a part of the first edge portion extends from the first plane to a third plane which is parallel to the first plane, and at least a part of the second edge portion extends from the first plane to a fourth plane which is parallel to the first plane. The heat transfer plate is characterized in that the second and third planes are arranged on the same side of the first plane, and the third plane is arranged on a distance d1>0 from the first plane such that said at least a part of the first edge portion projects from a front of the heat transfer plate. Further, the fourth plane is arranged on a distance d2≥0 from the first plane. Also, an edge of the first edge portion defines a first area and an edge of the second edge portion a second area, wherein the first area fits inside the second area.

As said above, the plate, or, more particularly, the metal sheet from which the plate is manufactured, has a thickness t. Herein, when reference is made to a specific plane, this plane extends in the center of the metal sheet, at t/2.

For example, a heat transfer plate according to the invention may be rectangular or circular. By a rectangular, or essentially rectangular heat transfer plate is meant a heat transfer plate having two opposing long sides and two opposing short sides, and cropped or non-cropped corners. In the case of an essentially rectangular heat transfer plate, the first and second sides referred to above may be the two opposing short sides.

The corrugations of the outer edge part of the heat transfer plate comprises alternately arranged ridges and valleys arranged to abut ridges and valleys of adjacent heat transfer plates in a PHE. The outer edge part of the heat transfer plate may comprise corrugations along its complete, or only one or more parts of its, extension.

The first and second edge portions may surround the first and second recesses completely, and thus be annular, or incompletely, and thus be semi-annular. Herein, by "annular" is not necessarily meant "circular" since the first and second recesses, and thus the first and second edge portions, may have many different shapes, such as oval or polygonal or a Y-shape.

In that the third plane is arranged separated from the first plane, and at least a part of the first edge portion extends to the third plane from the first plane, the first edge portion forms a first collar corresponding to the collars of the above described prior art plates.

Correspondingly, if the fourth plane is arranged separated from the first plane, since the second edge portion extends to the fourth plane from the first plane, the second edge portion forms a second collar corresponding to the collars of the above described prior art plates. However, if the fourth plane coincides with the first plane, i.e. if d2=0, the second edge portion will be flat and the second recess will be at least partly surrounded by a plane plate portion arranged in, and parallel to, the first plane.

The third and fourth planes could coincide, whereby the first and second edge portions would form collars of the same collar depth.

Depending i.a. on the plate thickness and the cutting and pressing tools used for manufacturing the plate, the first and second edge portions may extend from the first plane with different inclinations in relation to the first plane.

It should be stressed that the first plane defines a "zero position" and that all planes arranged on a "positive" distance, i.e. a distance >0, from the first plane are arranged on the same side of the first plane, while all planes (if any) arranged on a "negative" distance, i.e. a distance <0, from the first plane would be arranged on the opposite side of the first plane. Thus, if d2≠0, the third and fourth planes are arranged on the same side of the first plane.

The expressions "front" and "back" (the latter defined in a dependent claim) are used only to distinguish between the opposing sides of the heat transfer plate and do not impose, on the plate sides, any specific characteristics or requirements, e.g. as regards orientation in a PHE. The front could just as well be called the back and vice versa.

Depending on the design of the first and second recesses, the first and second areas may be open or closed. Since the first area defined by the edge of the first edge portion fits inside the second area defined by the edge of the second edge portion, the first area is smaller than the second area. Herein, by area is meant the area enclosed by the edge of the edge portion as seen when the front of the plate is viewed from a distance.

In that at least the first edge portion forms a first collar at least partly surrounding the first recess, a cassette comprising two heat transfer plates according to the invention will, as will be further discussed below, comprise at least one collar at each of two opposing sides thereof, which collars make the cassette more resistant to deformation as a result from engagement between the bars of a PHE and the cassette. Further, since the first area defined by the edge of the first edge portion is smaller than the second area defined by the edge of the second edge portion, the first edge portions, which form a respective first collar, of the cassette will be arranged closest to, and engage with, the bars of the PHE, when the cassette is mounted in the PHE. Furthermore, since the first area defined by the edge of the first edge portion is smaller than the second area defined by the edge of the second edge portion, the collars formed by the first edge portions of the cassette and any collars formed by the second edge portions of the cassette may be such as to not interfere with, or be in the way of, each other, whereby their collar depths, and thus strengths, may be optimized.

The first and second recesses may be formed as a respective hole through the heat transfer plate, which hole is arranged at a distance from the respective one of the first and second sides and completely surrounded by the respective one of the first and second edge portions. In such a case, the first and second areas defined by the edges of the first and second edge portions will be closed. Alternatively, the first and second recesses may extend from the first and second sides, respectively. Such first and second recesses are partly surrounded by the first and second edge portions and the first and second areas defined by the edges of the first and second edge portions are open. More particularly, the first and second areas will be enclosed by the edges of the first and second edge portions and imaginary shortest lines "closing" the first and second recesses.

The heat transfer plate may be such that the fourth plane is arranged at the same distance from the first plane as the third plane, i.e. such that d2=d1. Such an embodiment means that the collar depth of the collars formed by the first and second edge portions, i.e. the first and second collars, is the same. This is beneficial when it comes to heat transfer plate production in that the heat transfer plates, after pressing, can be arranged in non-tilting piles. However, even if d1 and d3 nominally are the same, d1 and d2 may vary slightly due to manufacturing tolerances.

The heat transfer plate may instead be such that the fourth plane is arranged closer to the first plane than the third plane, i.e. such that d2<d1. Such an embodiment means that the collar depth of the collar formed by the first edge portion, i.e. the first collar, is larger than the collar depth of the collar formed by the second edge portion, i.e. the second collar, which may be beneficial as the first collar is arranged to engage with the bars of the PHE.

The first and third planes may be arranged on opposite sides of the second plane, i.e. d1 may be larger than x. Further, d1 may be larger than (x+0.5t) which means that the collar formed by the first outer edge extends beyond the corrugations of the plate, i.e. has a relatively large collar depth, and thus is relatively strong.

The first and fourth planes may be arranged on opposite sides of the second plane, i.e. d2 may be larger than x. Further, d2 may be larger than (x+0.5t) which means that the collar formed by the second outer edge extends beyond the corrugations of the plate, i.e. has a relatively large collar depth, and thus is relatively strong.

The heat transfer plate may be such that the distance d1 between the first and third planes is ≤(2x+1.5t). Such an embodiment means that the collar formed by the first outer edge does not extend beyond the rest of a cassette comprising two heat transfer plates according to the invention, as will be further discussed below. Thereby, the risk of the first collar interfering with collars of other cassettes of the PHE may be eliminated.

The heat transfer plate may be such that the distance d2 between the first and fourth planes is ≤(2x+0.5t). Such an embodiment may eliminate a risk that the collar formed by the second edge portion of the heat transfer plate and another heat transfer plate of a cassette according to the invention interfere with each other.

The heat transfer plate may further comprise a gasket groove extending on a back of the heat transfer plate, a bottom of the gasket groove extending in the second plane. Such a heat transfer plate is suitable for use in a semi-welded PHE.

The heat transfer plate may be so designed that the first and second areas defined by the edges of the first and second edge portions of the heat transfer plate are essentially uniform (i.e. have essentially the same shape), but, as specified above, of different sizes. This embodiment enables an essentially constant distance between the first and second edge portions along their extensions which is beneficial as regards the strength of a cassette according to the invention.

A respective center of the first and second recesses of the heat transfer plate may be arranged on an imaginary straight recess center line extending parallel to a longitudinal center axis of the heat transfer plate. The imaginary straight recess center line may or may not coincide with the longitudinal center axis. Such an embodiment enables a relatively mechanically simple design of the heat transfer plate.

A cassette, for a plate heat exchanger, according to the present invention comprises bonded first and second heat transfer plates according the present invention. The second heat transfer plate is rotated 180 degrees about a transverse center axis in relation to the first heat transfer plate. Either a front of the first heat transfer plate abuts a front of the second heat transfer plate, or a back of the first heat transfer plate abuts a back of the second heat transfer plate. The first area of the first heat transfer plate is arranged within the second area of the second heat transfer plate, and the first area of the second heat transfer plate is arranged within the second area of the first heat transfer plate. The first and second heat transfer plates may be permanently bonded, such as welded, glued or brazed to each other.

The benefits of many, if not all, of the above discussed possible features of the inventive heat transfer plate become clear when two such heat transfer plates are combined into a cassette according to the present invention, since these features facilitates a smooth such combination.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which FIG. 6 is a schematic cross section of the cassette taken along line A-A in

FIG. 4,

DETAILED DESCRIPTION

Figure 1:
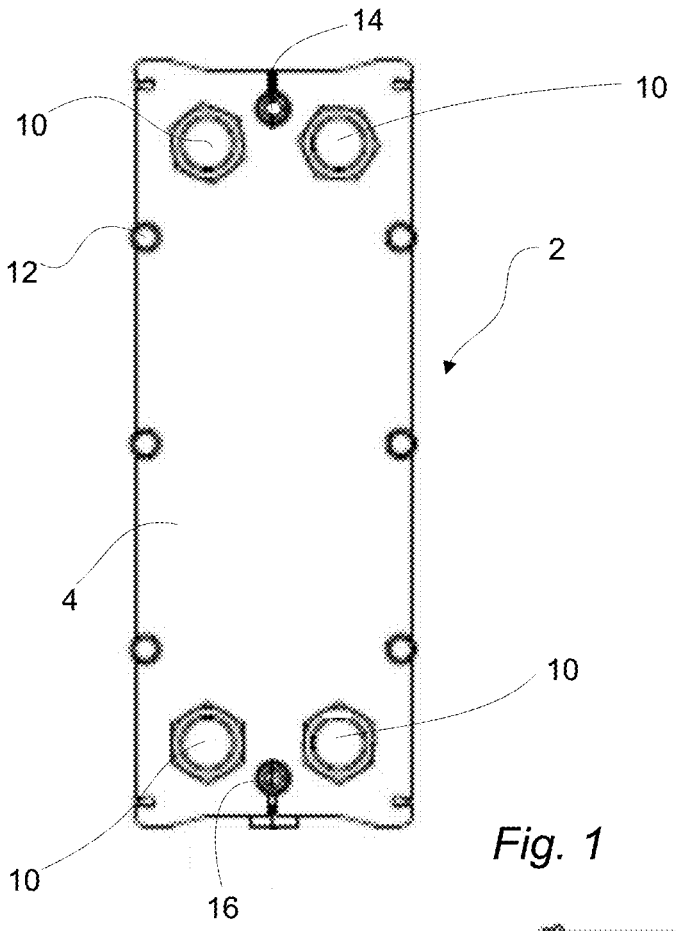
FIG. 1 is a schematic front view of a semi-welded plate heat exchanger.
Figure 2:
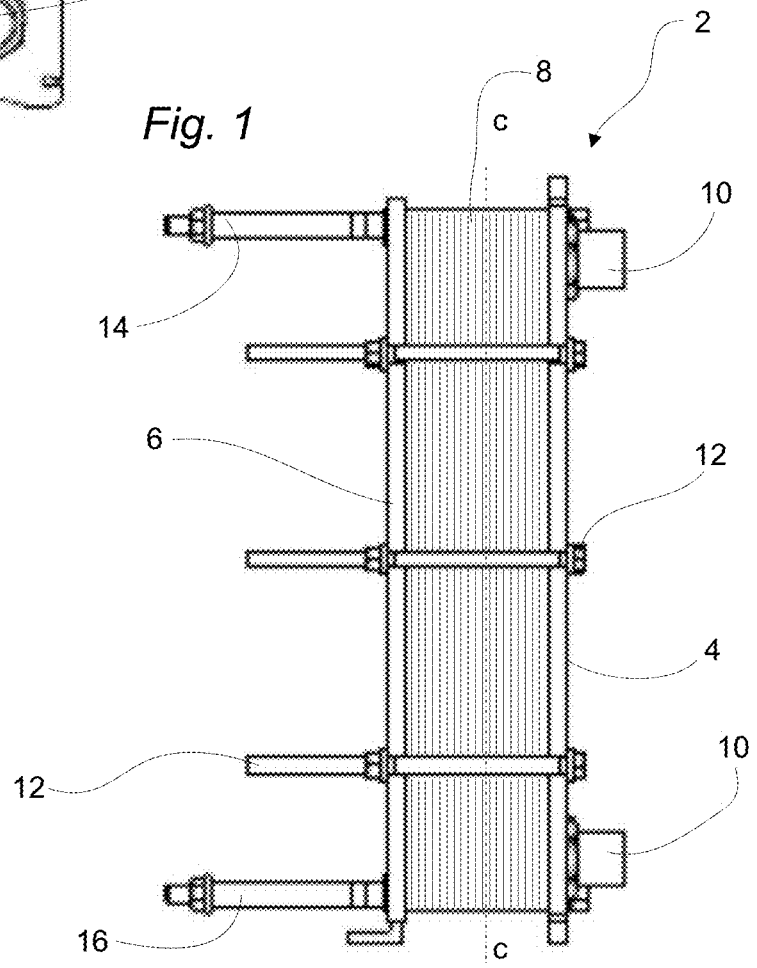
FIG. 2 is a schematic side view of the plate heat exchanger in FIG. 1.

FIGS. 1 and 2 show a semi-welded gasketed plate heat exchanger 2 as described by way of introduction. It comprises a frame plate 4, a pressure plate 6, a pack of heat transfer plates 8, fluid inlets and outlets 10, tightening means 12, an upper bar 14 and a lower bar 16.

The heat transfer plates 8, hereinafter also referred to as just "plates", are all similar. Two of them, denoted 8*a* and 8*b*, are illustrated in further detail in FIGS. 3 and 4, respectively. The plates 8*a* and 8*b* are essentially rectangular sheets of stainless steel. They comprise two opposing long sides 18, 20 and two opposing short sides 22, 24. Further, the plates each has a longitudinal center axis 26 extending parallel to, and half way between, the long sides 18, 20, and a transverse center axis 28 extending parallel to, and half way between, the short sides 22, 24 and thus perpendicular to the longitudinal center axis 26. Each of the plates 8*a*, 8*b* has a front 30 (illustrated in FIG. 3), a back 32 (illustrated in FIG. 4), a gasket groove 34 extending on the back 32 and four port holes 36, 38, 40 and 42.

The heat transfer plates 8*a*, 8*b* are pressed, in a conventional manner, in a pressing tool, to be given a desired structure, such as different corrugation patterns within different portions of the heat transfer plate. The corrugation patterns are optimized for the specific functions of the respective plate portions. Accordingly, the plates 8*a*, 8*b* comprise two distribution areas 44 which each is provided with a distribution pattern adapted for optimized fluid distribution across the heat transfer plate. Further, the plates 8*a*, 8*b* comprise a heat transfer area 46 arranged between the distribution areas 44 and provided with a heat transfer pattern adapted for optimized heat transfer between two fluids flowing on opposite sides of the heat transfer plate. Moreover, the plates 8*a*, 8*b* comprise an outer edge part 48 extending along an outer edge 50 of the plates. The outer edge part 48 comprises corrugations 52 arranged to abut corrugations of adjacent plates in the plate pack of the plate heat exchanger 2. Depending on the design of the distribution and heat transfer patterns, the plates 8*a*, 8*b* may or may not be arranged to abut the adjacent heat transfer plates also within the distribution and heat transfer areas 44 and 46, respectively. However, this is not further discussed herein.

Figure 3:
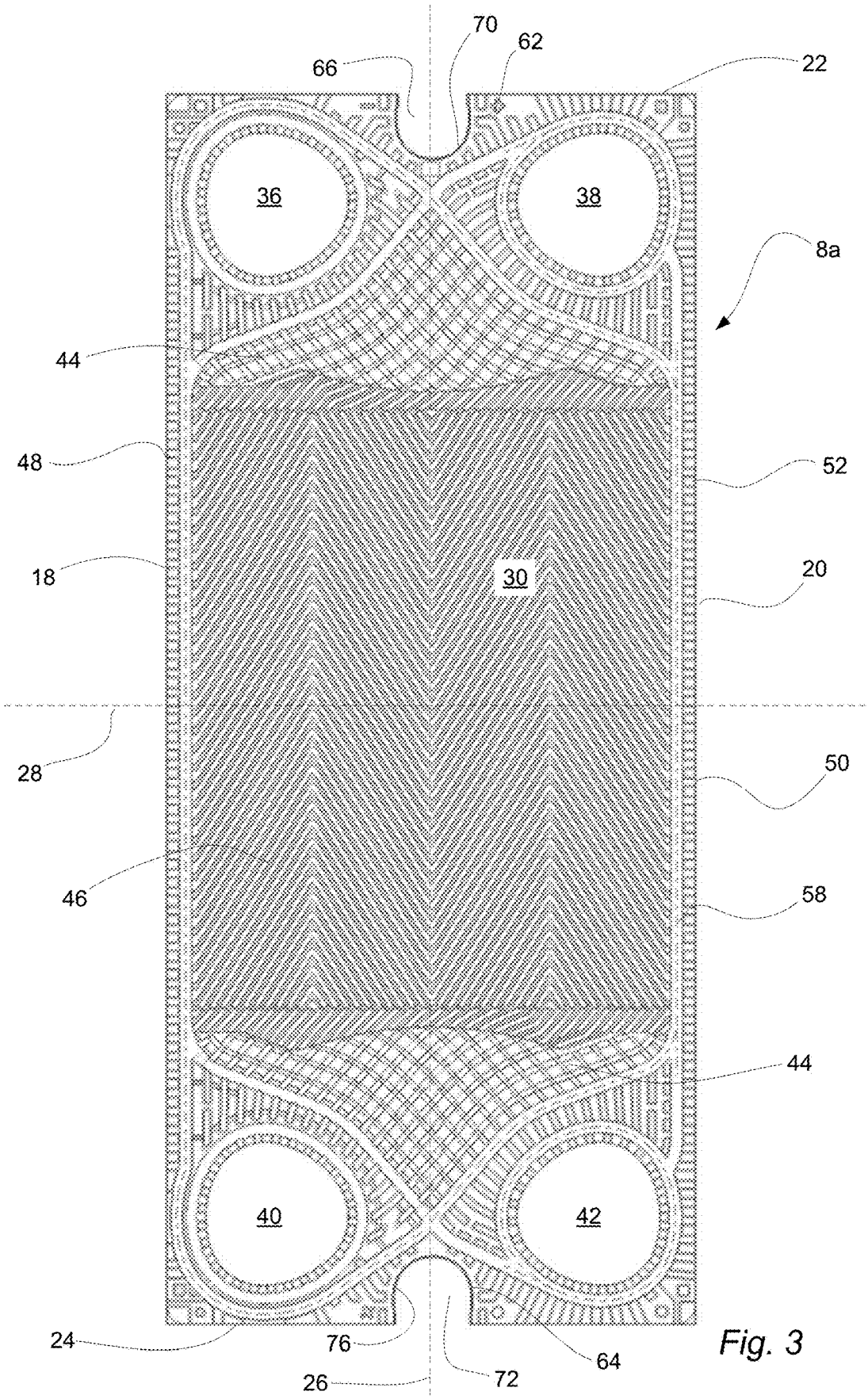
FIG. 3 is a schematic plan view of a heat transfer plate illustrating a front thereof.
Figure 4:
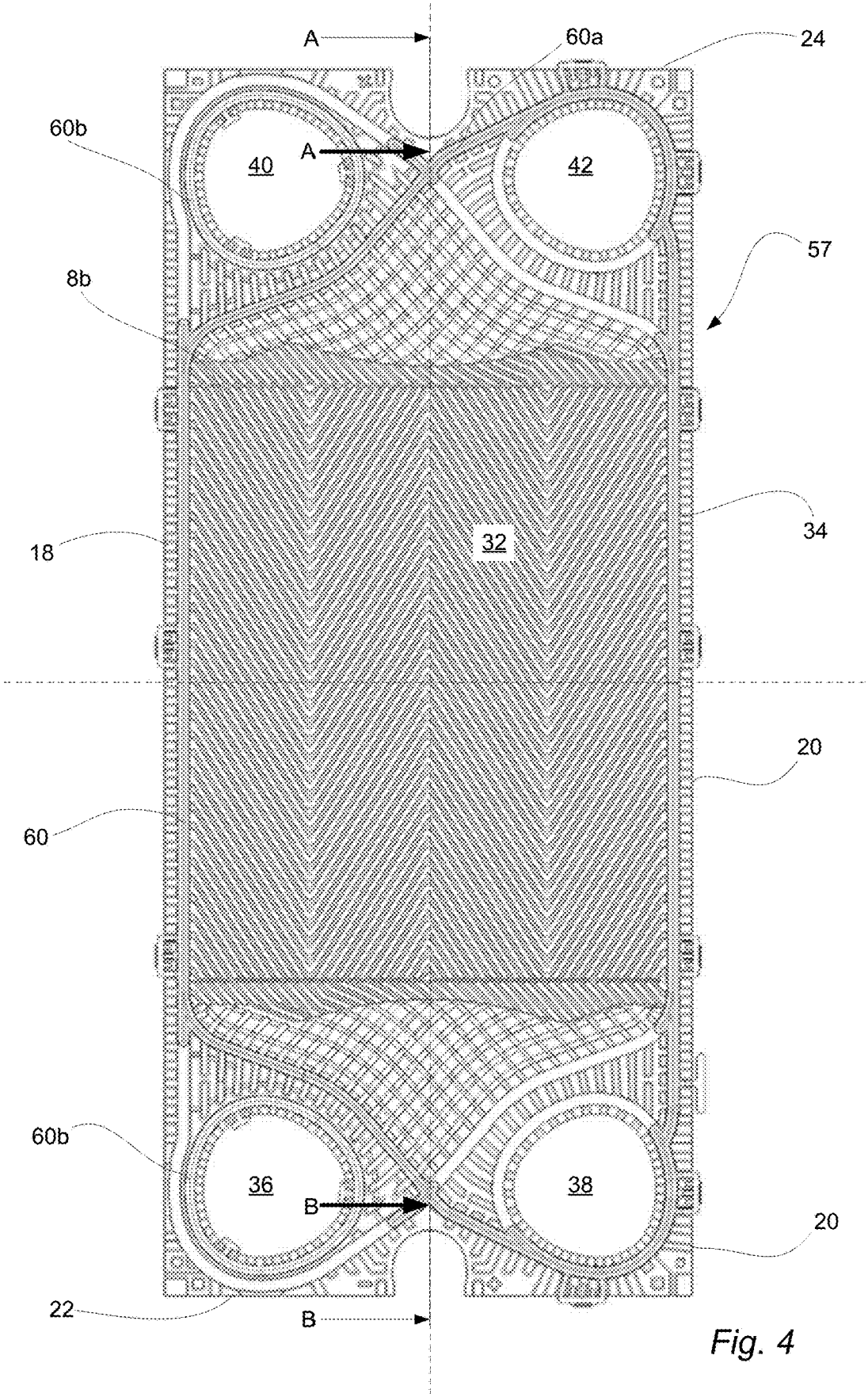
FIG. 4 is a schematic plan view of a heat transfer plate illustrating a back thereof, and a schematic plan view of a cassette.
Figure 5:
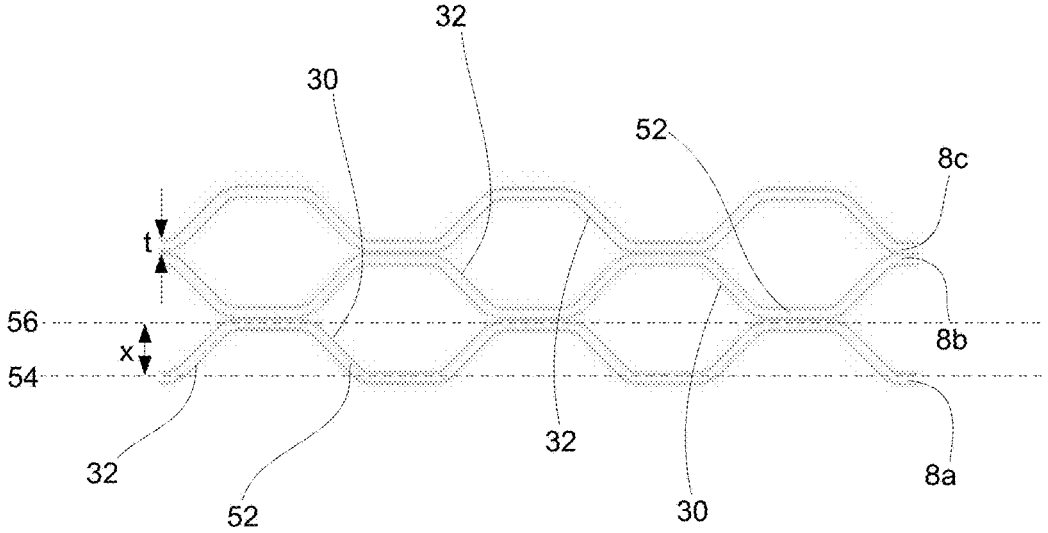
FIG. 5 illustrates abutting outer edge parts of adjacent heat transfer plates in a plate pack, as seen from the outside of the plate pack.

In the plate pack of the plate heat exchanger 2, the plates are arranged with the front 30 and the back 32 of one plate 8 facing the front and the back, respectively, of the neighboring heat transfer plates. Further, every second plate 8 is rotated 180 degrees (as illustrated in FIG. 4), in relation to a reference orientation (illustrated in FIG. 3), around a normal direction of the figure plane of FIG. 3. FIG. 5 illustrates the contact between the corrugations 52 of the outer edge parts 48 of the plates 8*a* and 8*b* and another plate 8*c* in the plate pack of the plate heat exchanger 2. As is illustrated for the plate 8*a*, the corrugations 52 extend between and in a first plane 54 and a second plane 56, which are parallel to the figure plane of FIG. 3. The first and second planes 54, 56 are separated by a distance x. A bottom of the gasket groove 34 (illustrated in FIG. 4) on the back 32 of the plates extends in the second plane 56. As is illustrated in FIG. 5, the plates have a thickness t.

The plates 8 of the plate pack are welded together in pairs, front 18 to front 18, to form cassettes 57. FIG. 4 shows one of the cassettes 57 comprising the plate 8*a* illustrated in FIG. 3 (not visible in FIG. 4) and the plate 8*b* visible in FIG. 4. The plates 8*a* and 8*b* are welded together along a weld line 58, illustrated with dashed lines in FIG. 3. The weld line 58 is discontinuous and partly aligned with the gasket groove 34 (not visible) on the back 32 of the plate 8*a*. On the left side, as seen in FIGS. 3 and 4, of the heat transfer plates 8*a*, 8*b*, the weld line 58 extends outside the gasket groove 34. In the plate pack of the plate heat exchanger 2, the welded cassettes 57 are separated by gaskets 60, which gaskets 60 are all similar, one of these gaskets 60 being illustrated in FIG. 4. Each of the gaskets 60 is arranged in the opposing gasket grooves 34 of two adjacent heat transfer plates 8 comprised in two adjacent cassettes 57. Here, each of the gaskets 60 is discontinuous so as to comprise a field portion 60*a* and two separate porthole portions 60*b*. However, in alternative embodiments the gasket could be continuous such that the field and porthole portions thereof are integrally formed.

Figure 8:
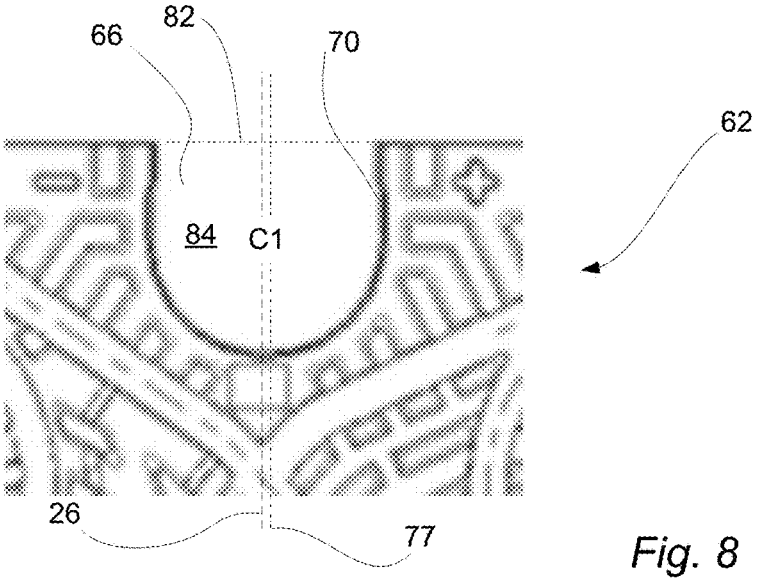
FIG. 8 is an enlargement of a first bar engagement portion of the heat transfer plate in FIG. 3.
Figure 9:
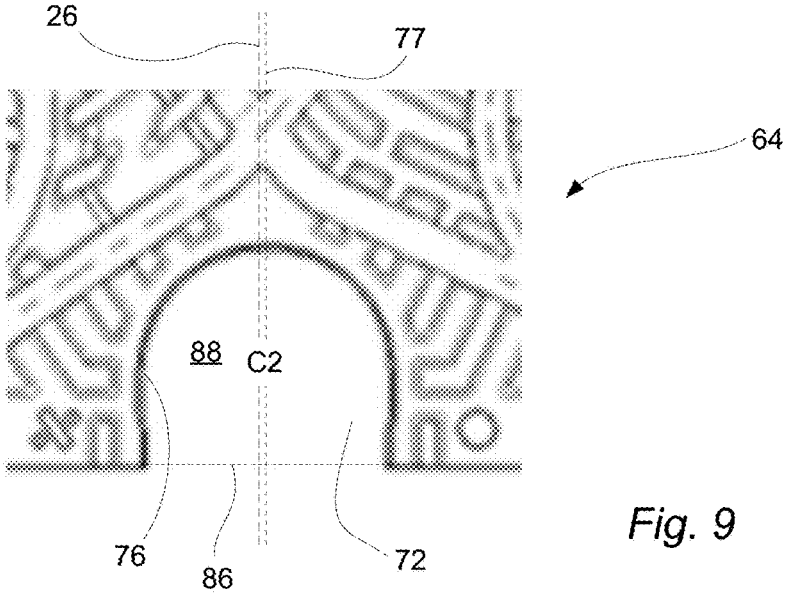
FIG. 9 is an enlargement of a second bar engagement portion of the heat transfer plate in FIG. 3.
Figure 6:
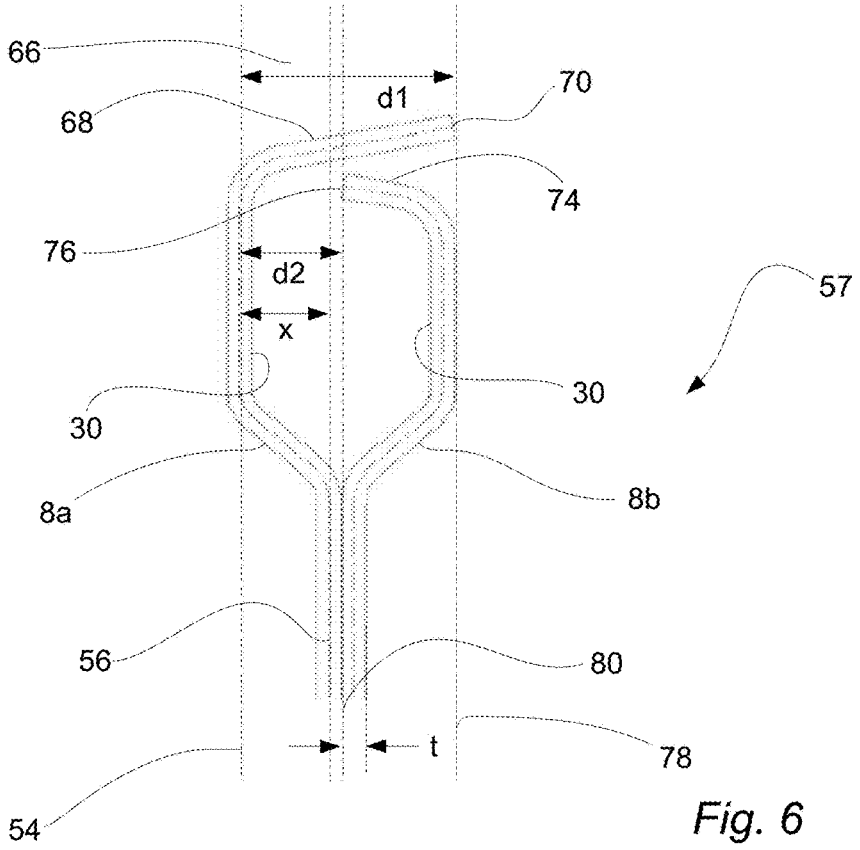
Figure 7:
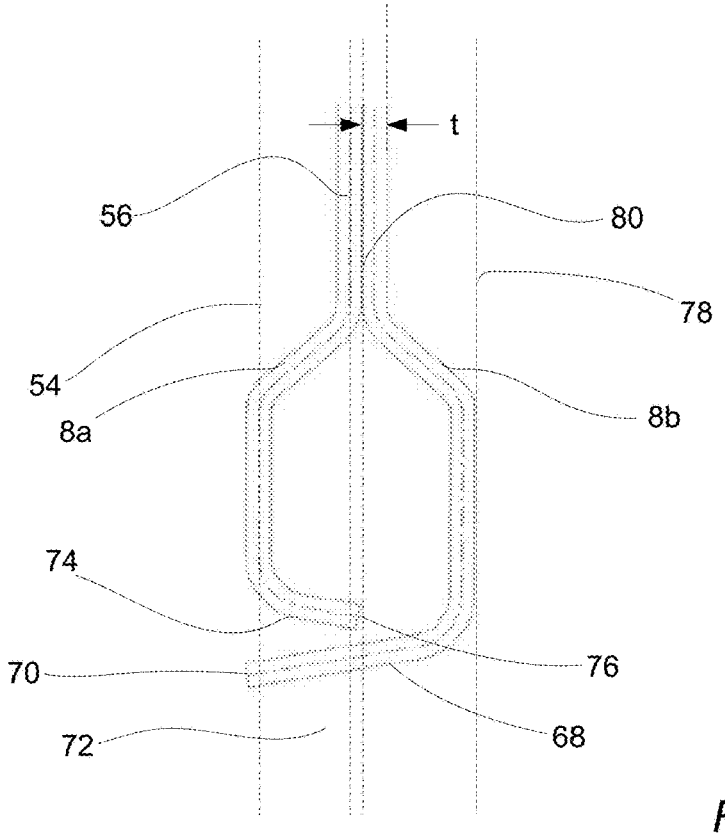
FIG. 7 is a schematic cross section of the cassette taken along line B-B in FIG. 4.

Details of the heat transfer plates 8 will now be described with reference particularly to plate 8*a* and FIGS. 3 and 6-9. The plate 8*a* comprises a first bar engagement portion 62 along the short side 22 and a second bar engagement portion 64 along the short side 24. In turn, the first bar engagement portion 62 comprises a first recess 66 for receiving a first bar or the upper bar 14 (FIG. 2) of the plate heat exchanger 2 and a first edge portion 68 with an edge 70 surrounding the first recess 66 (FIGS. 3, 6, 8). Similarly, the second bar engagement portion 64 comprises a second recess 72 for receiving a second bar or the lower bar 16 (FIG. 2) of the plate heat exchanger 2 and a second edge portion 74 with an edge 76 surrounding the second recess 72 (FIGS. 3, 7, 9). The first and second recesses 66 and 72 extend from the respective short sides 22 and 24, respectively. As illustrated in FIGS. 8 and 9, a respective center C1 and C2 of the first and second recesses 66 and 72 is arranged on an imaginary straight recess center line 77 extending parallel to the longitudinal center axis 26 of the heat transfer plate 8*a*. The imaginary straight recess center line 77 is displaced to the right of the longitudinal center axis 26 to make room for the weld line 58 extending outside the gasket groove 34 on the left side of the heat transfer plate 8*a*.

As is clear from FIG. 6, the first edge portion 68 extends from the first plane 54 to a third plane 78 which is parallel to the first plane 54. As is clear from FIG. 7, the second edge portion 74 extends from the first plane 54 to a fourth plane 80 which is parallel to the first plane 54. The second and third planes 56 and 78 are arranged on the same side of the first plane 54, and the third plane 78 is arranged on a distance d1>0, more particularly 2x+1.5t, from the first plane 54. This means that the first edge portion 68 forms a first collar projecting from the front 30 of the heat transfer plate 8*a*. The second and fourth planes 56 and 80 are arranged on the same side of the first plane 54, and the fourth plane 80 is arranged on a distance d2>0, more particularly x+0.5t, from the first plane 54. This means that the second edge portion 74 forms a second collar projecting from the front 30 of the heat transfer plate 8*a*.

With reference to FIG. 8, the edge 70 of the first edge portion 68 together with a first imaginary straight line 82 closing the first recess 66 define a first area 84. Similarly, with reference to FIG. 9, the edge 76 of the second edge portion 74 together with a second imaginary straight line 86 closing the second recess 72 define a second area 88. The first and second areas 84 and 88 are uniform, i.e. have the same shape, but the first area 84 is smaller than, and thus fits inside, the second area 88.

The above description is valid also for the heat transfer plate 8*b*, except that the first recess 66 of the first bar engagement portion 62 of the plate 8*b* is arranged for receiving the lower bar 16 (FIG. 2) of the plate heat exchanger 2, while the second recess 72 of the second bar engagement portion 64 of the plate 8*b* is arranged for receiving the upper bar 14 (FIG. 2) of the plate heat exchanger 2.

With reference to FIGS. 6 and 7, in the cassette 57 comprising the heat transfer plates 8*a* and 8*b*, the plates 8*a* and 8*b* have the orientations illustrated in FIGS. 3 and 4, respectively, and, as already said, they abut each other front 30 to front 30. Further, the second edge portion 74 of the plate 8*a* surrounds the first edge portion 68 of the plate 8*b* such that the first area 84 defined by the edge 70 of the first edge portion 68 of the plate 8*b* is within the second area 88 defined by the edge 76 of the second edge portion 74 of the plate 8*a*. Similarly, the second edge portion 74 of the plate 8*b* surrounds the first edge portion 68 of the plate 8*a* such that the first area 84 defined by the edge 70 of the first edge portion 68 of the plate 8*a* is within the second area 88 defined by the edge 76 of the second edge portion 74 of the plate 8*b*. As is clear from FIGS. 6 and 7, since the plates 8*a* and 8*b* have differently designed first and second bar engagement portions 62, 64, the first and second edge portions 68, 74 of the plates 8*a*, 8*b* will not interfere with each other in the cassette 57 even if they extend beyond the respective second plane 56 of the plates 8*a*, 8*b* so as to form relatively strong collars. Further, since the first and second edge portions 68, 74 of the plates 8*a*, 8*b* do not extend beyond the cassette 57, they will not interfere with other cassettes of the plate pack of the plate heat exchanger 2 irrespective of their inclination in relation to the first plane 54.

When the cassette 57 is arranged in the plate heat exchanger 2, the upper bar 14 extends through the first recess 66 of the plate 8*a* and the second recess 72 of the plate 8*b*, with the first edge portion 68 of the plate 8*a*, which forms a deeper and thus stronger collar than the second edge portion 74 of the plate 8*b*, closest to the upper bar 14. Similarly, the lower bar 16 extends through the first recess 66 of the plate 8*b* and the second recess 72 of the plate 8*a*, with the first edge portion 68 of the plate 8*b*, which forms a deeper and thus stronger collar than the second edge portion 74 of the plate 8*a*, closest to the lower bar 16.

Figure 10:
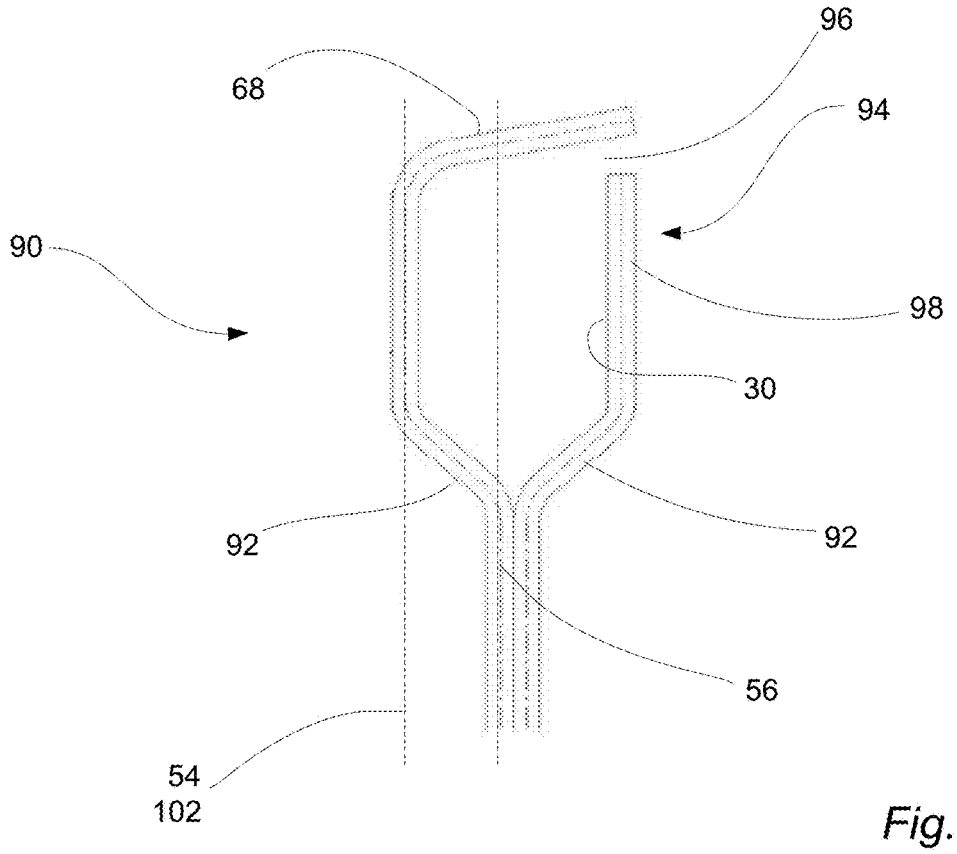
FIG. 10 is a schematic cross section of another cassette, corresponding to the cross section in FIG. 6.
Figure 11:
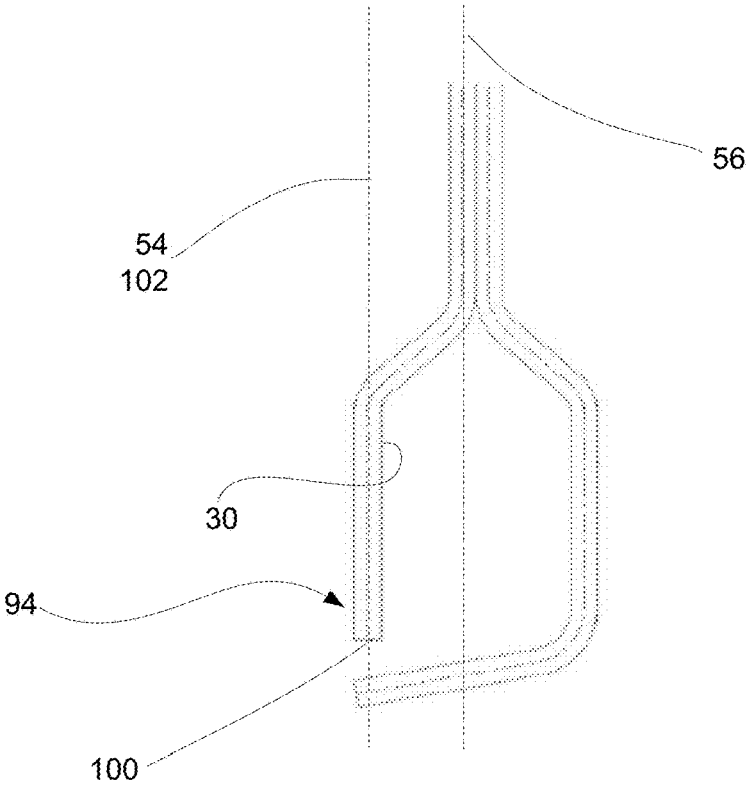
FIG. 11 is a schematic cross section of said another cassette, corresponding to the cross section in FIG. 7.

FIGS. 10 and 11 illustrate a cassette 90 comprising heat transfer plates 92 which are designed like the heat transfer plates 8*a*, 8*b* except for when it comes to the second bar engagement portion. Hereinafter, only the differences between the second bar engagement portions of the plates 92 and 8*a*, 8*b* will be described. The plates 92 comprise a respective second bar engagement portion 94 in turn comprising a second recess 96 for receiving the upper or lower bar 14, 16 (FIG. 2) of the plate heat exchanger 2 and a second edge portion 98 with an edge 100 surrounding the second recess 96. The second edge portion 98 extends from a first plane 54 to a fourth plane 102. The fourth plane 102 is arranged on a distance d2=0 from the first plane 54, i.e. the fourth plane 102 coincides with the first plane 54. This means that the second edge portion 98 is plane and extends parallel to the first plane 54 and therefore forms no collar projecting from a front 30 of the heat transfer plate 90. The edge 100 of the second edge portion 98 together with a second imaginary straight line (not illustrated) closing the second recess 96 define a second area which is uniform with, but larger than, a first area defined by a first bar engagement portion of the plates 92.

In the cassette 90 comprising the heat transfer plates 92, one of the plates 92 is turned up-side-down in relation to the other plate, and the plates are welded to each other front 30 to front 30. Further, the second edge portion 98 of each of the plates 92 surrounds a first edge portion 68 of the other plate 92. Since the plates 92 have differently designed first and second bar engagement portions, the first and second edge portions 68, 98 of the plates 8*a*, 8*b* will not interfere with each other in the cassette 90 even if the first edge portion 68 extend beyond respective second planes 56 of the plates so as to form a relatively strong collar.

The above described embodiments of the present invention should only be seen as examples. A person skilled in the art realizes that the embodiments discussed can be varied in a number of ways without deviating from the inventive conception.

Figure 12:
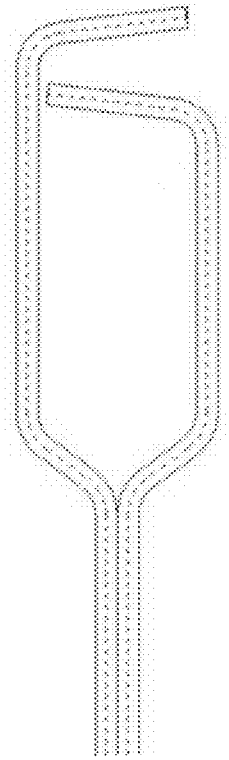
FIG. 12 is a schematic cross section of yet another cassette, corresponding to the cross section in FIG. 6.
Figure 13:
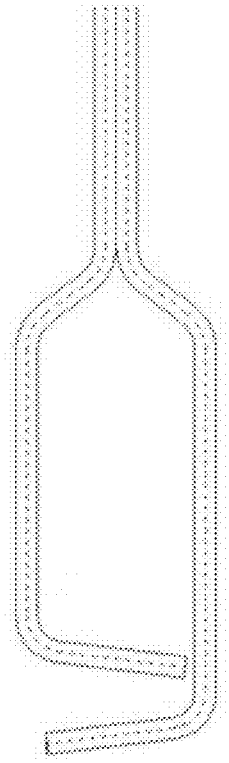
FIG. 13 is a schematic cross section of said yet another cassette, corresponding to the cross section in FIG. 7.

As an example, the third plane can be arranged on another distance, both larger and smaller, from the first plane than the distance in the embodiments described. Similarly, the fourth plane can be arranged on another distance from the first plane than the distances in the embodiments described. For example, as is illustrated in FIGS. 12 and 13, the third and fourth planes can be arranged on the same distance from the first plane such that the collars formed by the first and second edge portions of the plate have the same collar depth, i.e. such that d1=d2.

In the above described embodiments, the plates and the gaskets between the cassettes are all similar, but this is not mandatory. As an example, in a plate pack, plates of different types may be combined.

Any collar formed by the first and second edge portions of the plate need not have a constant, but may have a varying, collar depth ≥0 along its extension.

Figure 14:
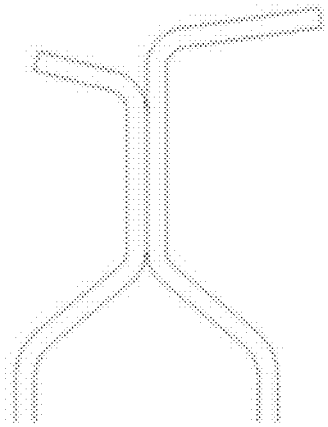
FIG. 14 is a schematic cross section of yet a further cassette, corresponding to the cross section in FIG. 6.
Figure 15:
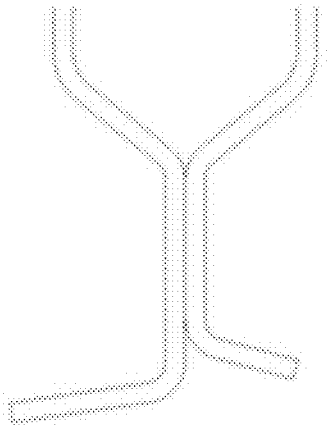
FIG. 15 is a schematic cross section of said yet a further cassette, corresponding to the cross section in FIG. 7.

In the above described embodiments, the heat transfer plates of a cassette are arranged such that the collars of the plates point towards each other. In alternative embodiments, as is illustrated in FIGS. 14 and 15, the plates of a cassette could instead be arranged such that the collars point away from each other. Then, if the plates have the features as specified in the independent claim, the collars of the cassette will not interfere with the collars of other cassettes in a plate pack.

The plates could be alternatively "rotated" instead of alternatively "flipped" in relation to each other as in the above described embodiments.

The inventive heat transfer plate could be used in connection with other types of plate heat exchangers than semi-welded ones, for example gasketed plate heat exchangers.

In the above first described embodiment, the first and second edge portions extend on the same side of the heat transfer plate and the edges of the first and second edge portions point away from the plate. In an alternative embodiment, the first and second edge portions could still extend on the same side of the heat transfer plate but one of the edges of the first and second edge portions could point away from, and the other one could point towards, the plate (for example by being bent 180 degrees).

It should be stressed that the attributes first, second, third, etc. is used herein just to distinguish between species of the same kind and not to express any kind of mutual order between the species.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

LIST OF REFERENCE NUMERALS

2 semi-welded gasketed plate heat exchanger
4 frame plate
6 pressure plate
8 heat transfer plate
8*a* (first) heat transfer plate
8*b* (second) heat transfer plate
10 fluid inlets and fluid outlet
12 tightening means
14 upper bar (first bar)
16 lower bar (second bar)
18, 20 long sides
22, 24 short sides (first and second sides)
26 longitudinal centre axis
28 transverse centre axis
30 plate front
32 plate back
34 gasket groove
36, 38, 40, 42 port holes
44 distribution area
46 heat transfer area
48 outer edge part
50 outer edge
52 corrugations
54 first plane
56 second plane
57 cassette
58 weld line
60 gasket
60*a* gasket field portion
60*b* gasket porthole portion
62 first bar engagement portion
64 second bar engagement portion
66 first recess

68 first edge portion
70 edge of the first edge portion
72 second recess
74 second edge portion
76 edge of the second edge portion
77 imaginary straight recess center line
78 third plane
80 fourth plane
82 first imaginary straight line
84 first area
86 second imaginary straight line
88 second area
90 cassette
92 heat transfer plates
94 second bar engagement portion
96 second recess
98 second edge portion
100 edge of the second edge portion
102 fourth plane
C1 center of first recess
C2 center of second recess
d1 distance between first and third planes
d2 distance between first and fourth planes
t plate thickness
x distance between first and second planes

The invention claimed is:

1. A heat transfer plate for a plate heat exchanger, having a thickness t and comprising first and second opposing sides, a first bar engagement portion along the first side, a second bar engagement portion along the second side, and an outer edge part comprising corrugations extending between and in first and second planes, which first and second planes are parallel to each other, a distance between the first and second plane=x, the first bar engagement portion comprising a first recess for receiving a first bar of the plate heat exchanger and a first edge portion surrounding the first recess, and the second bar engagement portion comprising a second recess for receiving a second bar of the plate heat exchanger and a second edge portion surrounding the second recess, at least a part of the first edge portion extending from the first plane to a third plane which is parallel to the first plane, and at least a part of the second edge portion extending from the first plane to a fourth plane which is parallel to the first plane, wherein the second and third planes are arranged on the same side of the first plane, the third plane is arranged on a distance d1>0 from the first plane such that said at least a part of the first edge portion projects from a front of the heat transfer plate, the fourth plane is arranged on a distance d2≥0 from the first plane, and an edge of the first edge portion defines a first area and an edge of the second edge portion a second area, wherein the first area fits inside the second area.

2. A heat transfer plate according to claim 1, wherein the first and second recesses extend from the first and second sides, respectively.

3. A heat transfer plate according claim 1, wherein d2=d1.

4. A heat transfer plate according to claim 1, wherein d2<d1.

5. A heat transfer plate according to claim 1, wherein the first and third planes are arranged on opposite sides of the second plane.

6. A heat transfer plate according to claim 1, wherein d1>(x+0.5t).

7. A heat transfer plate according to claim 1, wherein the first and fourth planes are arranged on opposite sides of the second plane.

8. A heat transfer plate according to claim 1, wherein d2>(x+0.5t).

9. A heat transfer plate according to claim 1, wherein the distance d1 between the first and third planes is ≤(2x+1.5t).

10. A heat transfer plate according to claim 1, wherein the distance d2 between the first and fourth planes is ≤(2x+0.5t).

11. A heat transfer plate according to claim 1, further comprising a gasket groove extending on a back of the heat transfer plate, a bottom of the gasket groove extending in the second plane.

12. A heat transfer plate according to claim 1, wherein the first and second areas are essentially uniform.

13. A heat transfer plate according to claim 1, wherein a respective center of the first and second recesses is arranged on an imaginary straight recess center line extending parallel to a longitudinal center axis of the heat transfer plate.

14. A cassette for a plate heat exchanger, comprising bonded first and second heat transfer plates according to claim 1, wherein the second heat transfer plate is rotated 180 degrees about a transverse center axis in relation to the first heat transfer plate, a front of the first heat transfer plate abuts a front of the second heat transfer plate, the first area of the first heat transfer plate is arranged within the second area of the second heat transfer plate, and the first area of the second heat transfer plate is arranged within the second area of the first heat transfer plate.

15. A cassette for a plate heat exchanger, comprising bonded first and second heat transfer plates according to claim 1, wherein the second heat transfer plate is rotated 180 degrees about a transverse center axis in relation to the first heat transfer plate, a back of the first heat transfer plate abuts a back of the second heat transfer plate, the first area of the first heat transfer plate is arranged within the second area of the second heat transfer plate, and the first area of the second heat transfer plate is arranged within the second area of the first heat transfer plate.

* * * * *